US007731382B2

(12) United States Patent
Wu et al.

(10) Patent No.: US 7,731,382 B2
(45) Date of Patent: Jun. 8, 2010

(54) LAMP STRUCTURE

(75) Inventors: Cheng-Hsiu Wu, Taipei (TW); Chih Chun Li, Taipei (TW)

(73) Assignee: Feton Limited, Taipei (TW)

( * ) Notice: Subject to any disclaimer, the term of this patent is extended or adjusted under 35 U.S.C. 154(b) by 278 days.

(21) Appl. No.: 11/867,279

(22) Filed: Oct. 4, 2007

(65) Prior Publication Data

US 2009/0091923 A1 Apr. 9, 2009

(51) Int. Cl.
*F21V 33/00* (2006.01)
*F21V 21/00* (2006.01)
*F21L 4/00* (2006.01)

(52) U.S. Cl. ..... 362/133; 362/155; 362/157; 362/249.05

(58) Field of Classification Search ..... 362/155, 362/133, 206, 200, 201, 157, 249.05; 200/61.62, 200/61.7, 61.71, 61.73, 61.74, 61.75, 61.76, 200/61.81, 530, 531, 536
See application file for complete search history.

(56) References Cited

U.S. PATENT DOCUMENTS

| | | | | | |
|---|---|---|---|---|---|
| 2,436,898 | A * | 3/1948 | Rickmeyer | ..... | 200/530 |
| 4,442,478 | A * | 4/1984 | Stansbury | ..... | 362/489 |
| 5,032,957 | A * | 7/1991 | Canfield | ..... | 362/133 |
| 5,552,964 | A * | 9/1996 | Naito | ..... | 361/781 |
| 6,033,084 | A * | 3/2000 | Burke | ..... | 362/155 |
| 6,953,258 | B1 * | 10/2005 | Goins | ..... | 362/155 |
| 2005/0231941 | A1 * | 10/2005 | Huang | ..... | 362/208 |
| 2006/0087836 | A1 * | 4/2006 | Morris et al. | ..... | 362/155 |

* cited by examiner

*Primary Examiner*—Jong-Suk (James) Lee
*Assistant Examiner*—David R Crowe

(57) ABSTRACT

The present invention relates to a lamp structure. The lamp structure is mainly installed inside a cabinet, and by opening the cabinet door will enable the electrical circuit of the lamp structure to be a close circuit; vise versa, closing the cabinet door will result in the open circuit of the electrical circuit of the lamp structure. When the electrical circuit is a close circuit, the light emitting part of the lamp structure will generate light to illuminate the internal space of the cabinet so as clearly view the objects location in the cabinet.

7 Claims, 7 Drawing Sheets

LAMP STRUCTURE

FIELD OF THE INVENTION

The present invention relates to a lamp structure, more particularly to, a lamp structure installed internal to a cabinet.

BACKGROUND OF THE INVENTION

Our everyday lives have become more and more convenient by each day, where we can see significant improvements to what we eat, what we wear, where we live, or how we travel; even still, the limitless human desire will not be easily satiated and we will continue take note of every single inconveniences in our lives in search of quick and easy solutions; as such, cabinets commonly present in homes or offices are usually available for storing things and objects, and are occasionally placed at locations low in visible light; these cabinets usually do not feature lighting equipment and the cabinets that are installed with lighting equipments are usually higher in cost, and some even require external power sockets to be able to utilize the lighting equipments, therefore these cabinets are not practical in reality; in light of this, the inventor after various modifications and research has created the innovative lamp structure.

SUMMARY OF THE INVENTION

The present invention relates to a lamp structure. The main object of the present invention is to provide a mechanism configuration, and the opening or closing action of the cabinet door will activate the mechanism, subsequently achieving automatic activation of the light-emitting element to generate the illumination effect through the non-electrical sensing method, in addition to conserving the power consumption of the lamp structure.

Another object of the present invention is to provide a lamp structure using batteries as the power source, thereby improving the convenience of installation for the lamp structure.

The present invention relates to a lamp structure which comprises a case including a housing structure with a hollow part, and the portion of the surface of the case includes an opening part penetrating through to the hollow part; a light emitting part including a plurality of light emitting elements installed on the surface of the box; a power supply as the main power source to the entire structure; an electrical circuit electrically connected between the light emitting part and the power supply, wherein the electrical circuit comprises a first electrical contact and a second electrical contact, the first and second electrical contact are open circuited in between; a sliding piece placed inside the case and is restricted between a first position and a second position, and the portions of the surface of the sliding piece has a conductor and an extension, the conductor is a conductive material that corresponds to the first electrical contact and the second electrical contact, and one end of the extension is connected to the sliding piece and the other end protrudes through the opening part and protrudes to the surface of the case; and a spring element that is a mechanical element with elastic recovery force, one end of the spring element is installed to the case, and the other end is secured to the sliding piece, wherein the conductor of the sliding piece can select an either state of a open circuit state or a close circuit state between the first electrical contact and the second electrical contact, in which, the close circuit state is the state of the conductor is electrically connected to the first electrical contact and the second electrical contact, the open circuit state is the state of the conductor is disengaged from the first electrical contact and the second electrical contact; the first position corresponds to the open circuit state selected by the sliding piece, and the second position corresponds to the close circuit state selected by the sliding piece; the protruded position of the extension of the sliding piece relative to (he surface of the case corresponds to one of the first position and second position of the sliding piece, to determine whether if the light emitting element receives power for generating the light for illumination.

The objects, advantages, and novel features of the invention will become more apparent to those skilled in the art by referencing the accompanying drawings and the following detailed description.

DETAILED DESCRIPTION OF THE INVENTION

Figure 1:
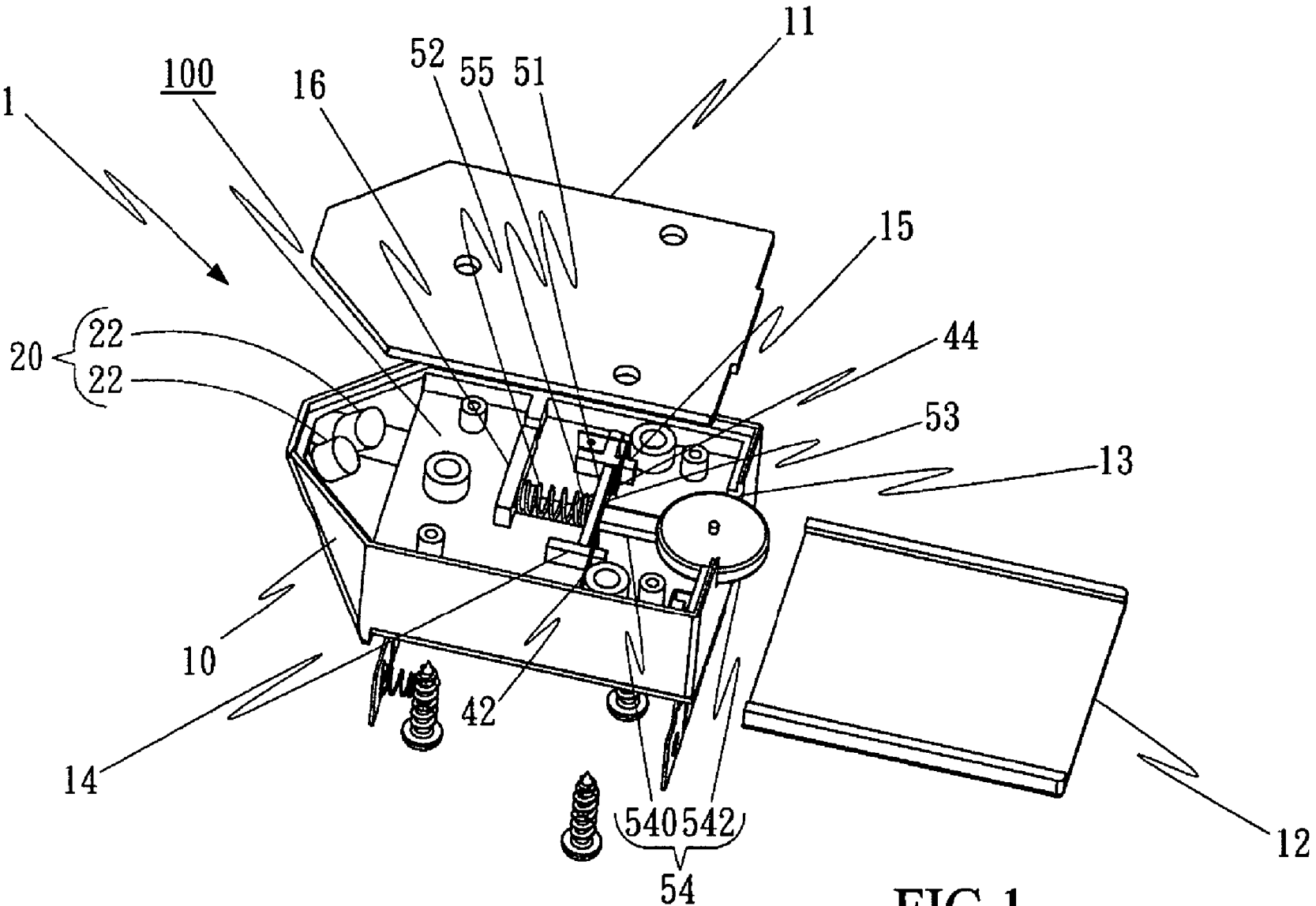
FIG. 1 is the 3D exploded diagram I of the lamp structure according the present invention.
Figure 2:
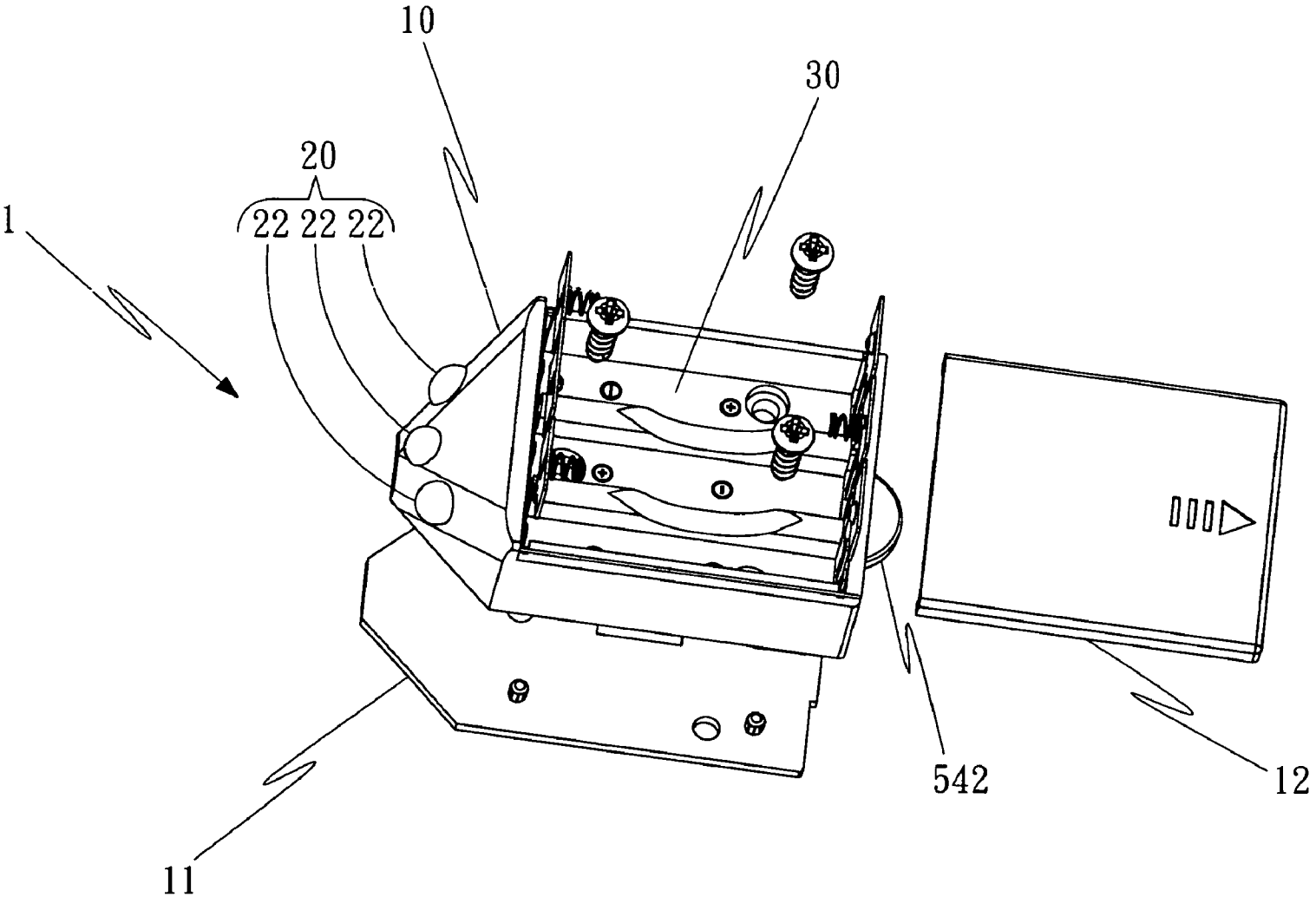
FIG. 2 is the 3D exploded diagram II of the lamp structure according the present invention.
Figure 3:
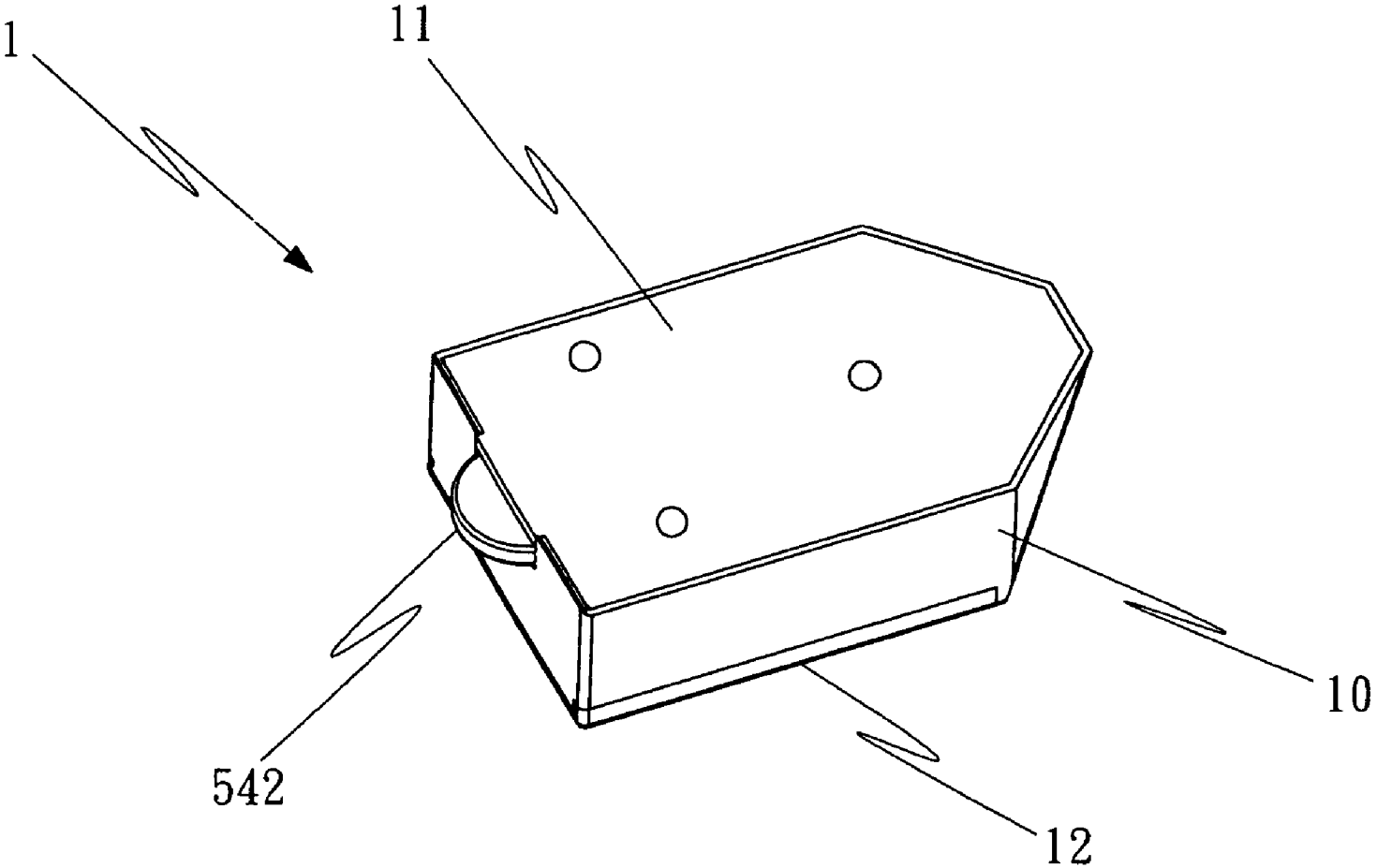
FIG. 3 is the 3D assembly diagram I of the lamp structure according the present invention.
Figure 4:
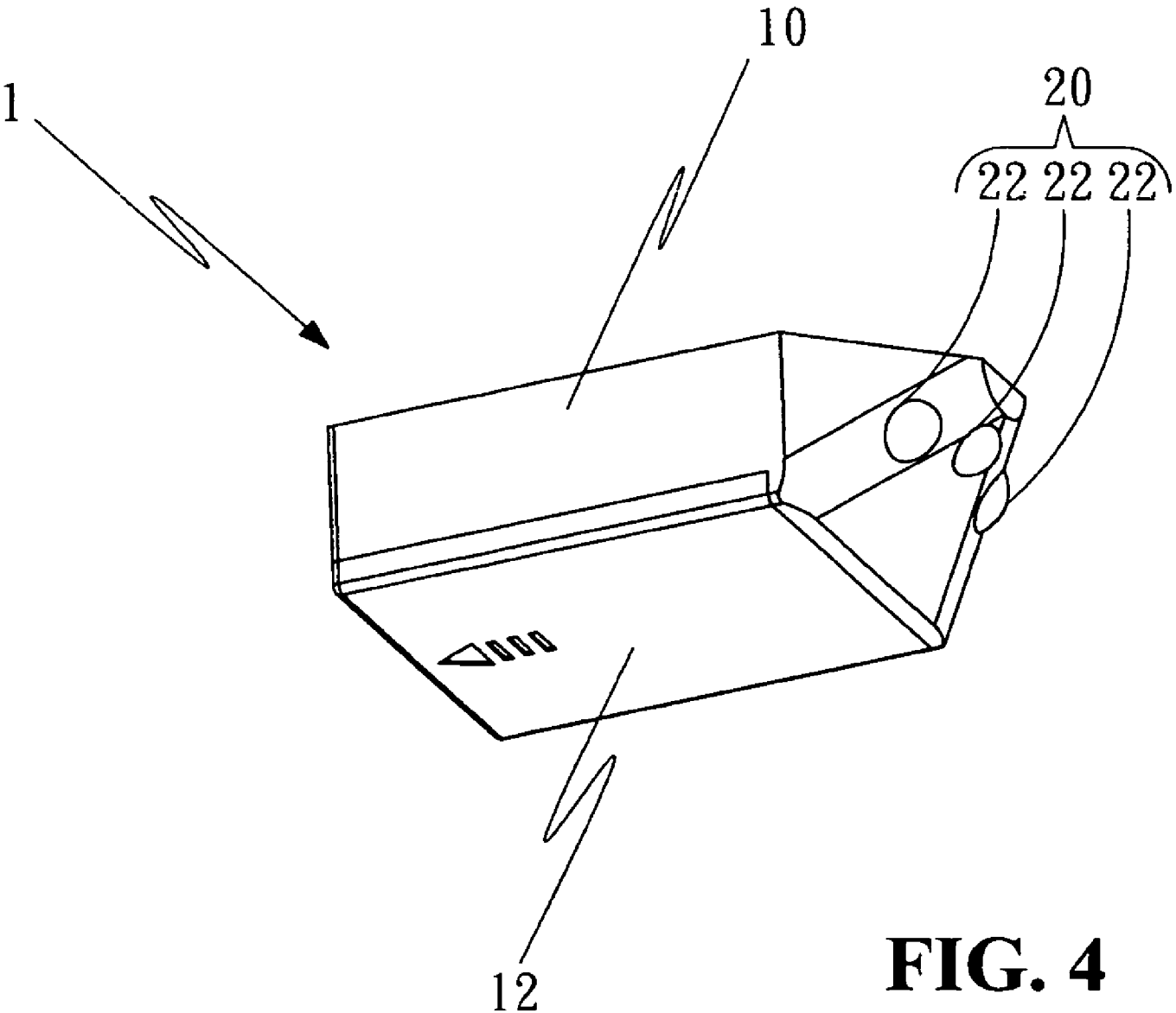
FIG. 4 is the 3D assembly diagram II of the lamp structure according the present invention.
Figure 5:
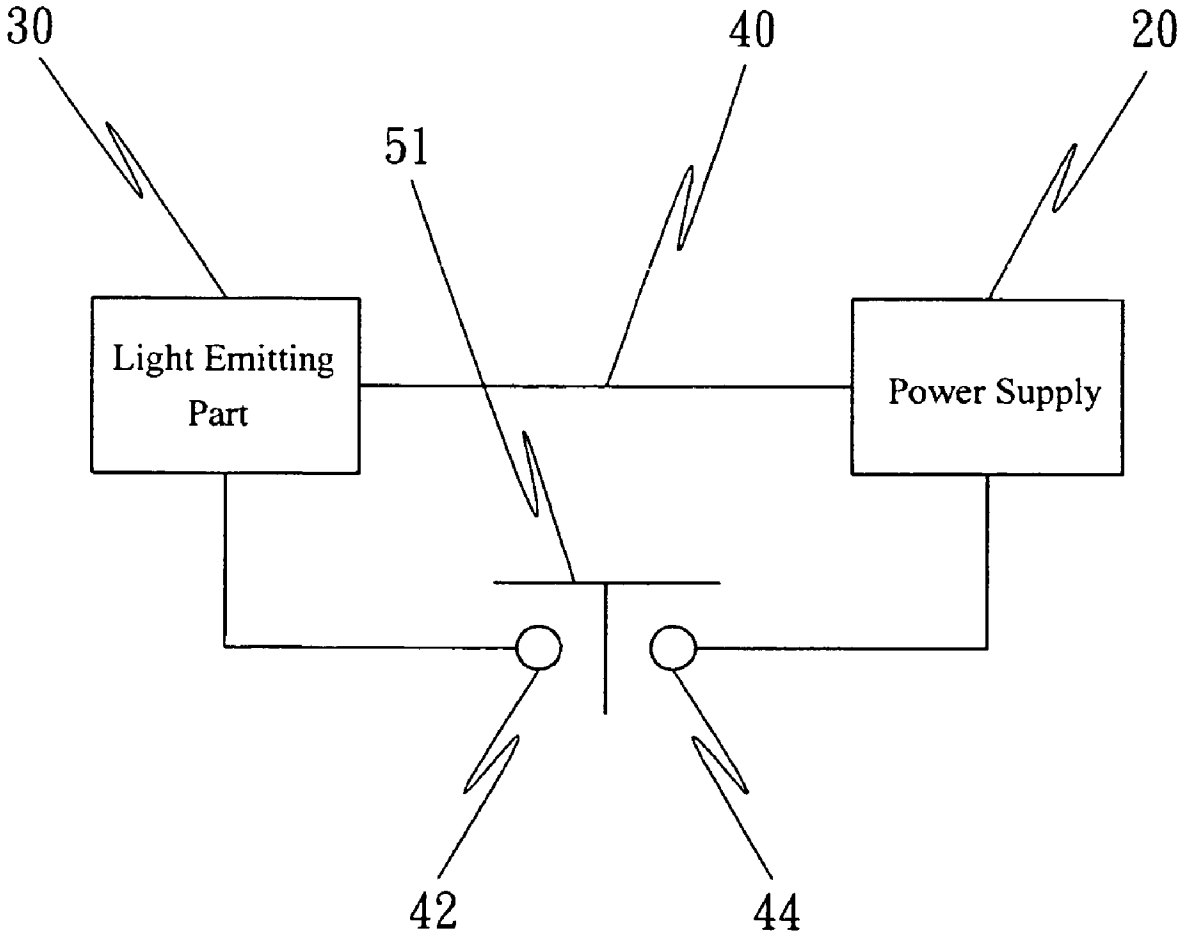
FIG. 5 is the electrical circuit diagram of the lamp structure according the present invention.
Figure 6:
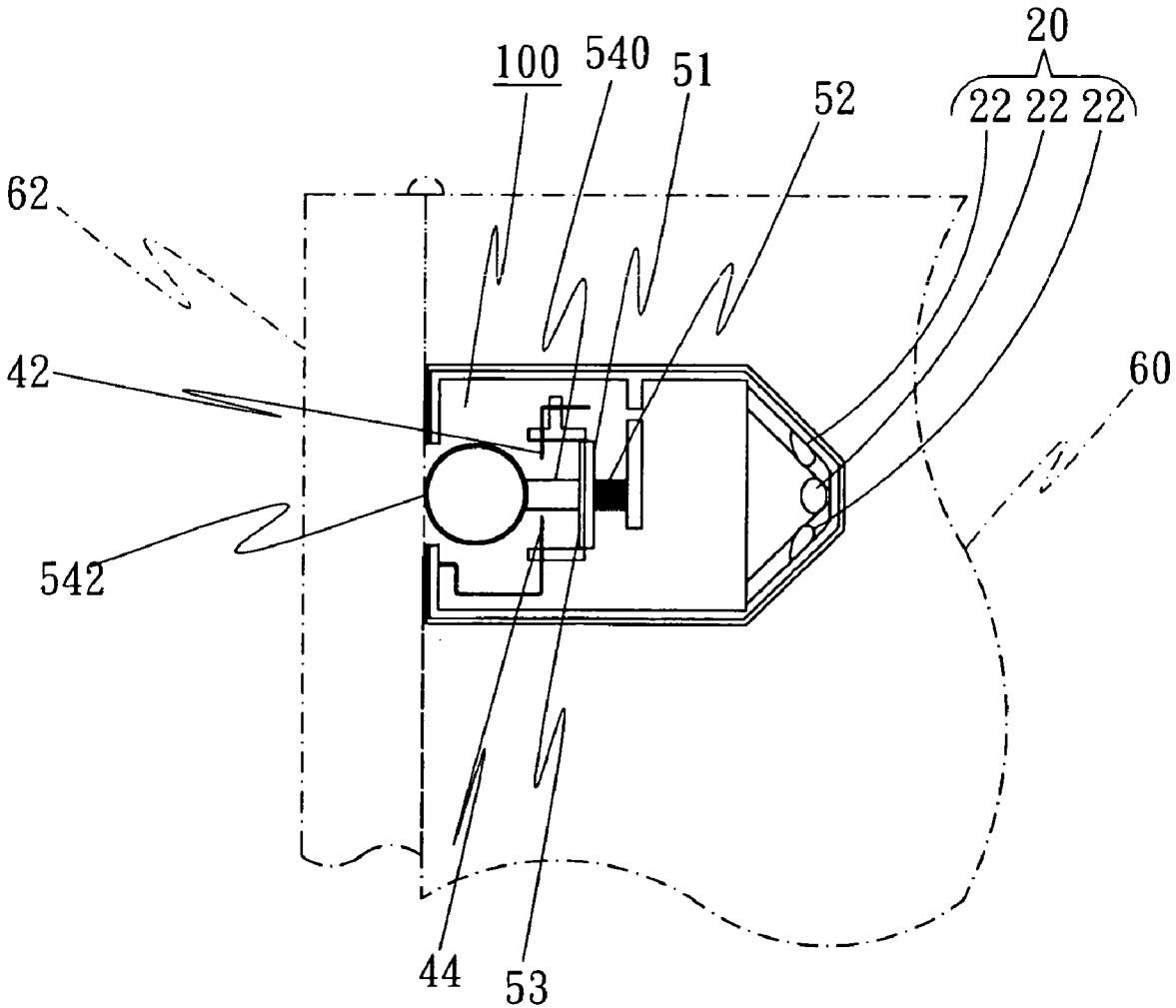
FIG. 6 is the schematic diagram for the first position of the lamp structure installed in the cabinet.
Figure 7:
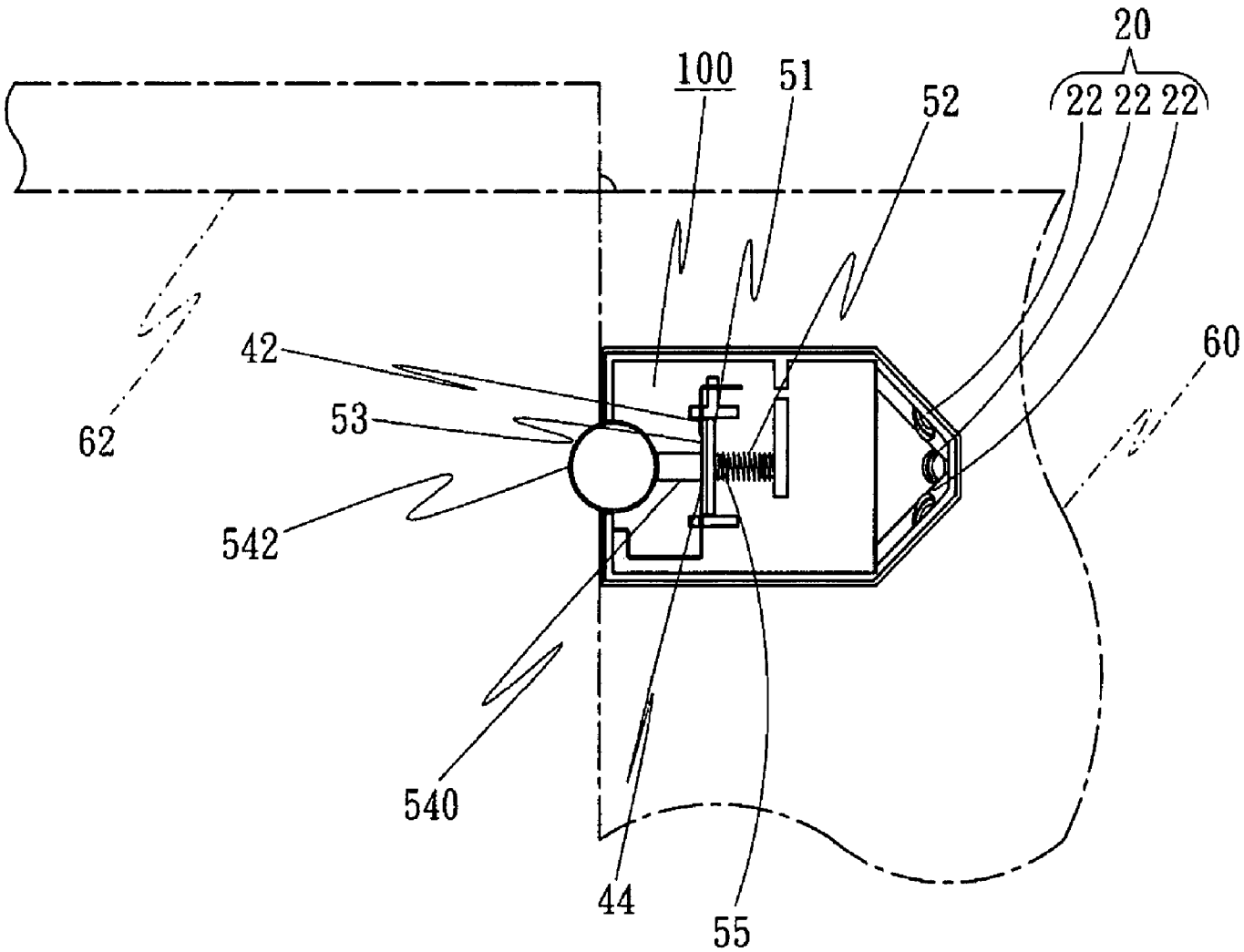
FIG. 7 is the schematic diagram for the second position of the lamp structure installed in the cabinet.

Referring to FIG. 1 to FIG. 7, FIG. 1 is the 3D exploded diagram I of the lamp structure according the present invention; FIG. 2 is the 3D exploded diagram II of the lamp structure according the present invention; FIG. 3 is the 3D assembly diagram I of the lamp structure according the present invention; FIG. 4 is the 3D assembly diagram II of the lamp structure according the present invention; FIG. 5 is the electrical connection relationship of the element of the lamp structure according the present invention; FIG. 6 is the plan view of one state of the first position of the lamp structure according the present invention; and FIG. 7 is the plan view of one state of the second position of the lamp structure according the present invention. The present invention relates to a lamp structure (1) comprises a case (10), a light emitting part (20), a power supply (30), an electrical circuit (40) (please refer to as indicated in FIG. 5), a sliding piece (51), and a spring element (52); the embodiments of the present invention are described in details below.

In the above-mentioned inventive lamp structure (1), the case (10) is a housing structure with a hollow part (100) that has a top opening and a lower opening; an upper lid (11) and a lower lid (12) are provided to seal the two openings; one end of the case (10) has an opening part (13) for the hollow part (100) of the case (10) communicating with the outside of the case (10).

In the inventive lamp structure (1), the light emitting part (20) comprises a plurality of light emitting elements (22), which can be LED (light emitting diode) or any light source driven by DC current source, and the light emitting elements (22) are installed in the case (10) where the light emitting areas are exposed at the portion surface to provide light illumination. Furthermore, the light emitting area of each light emitting element (22) is packaged with colored light-transmitting units to enable the light emitting elements (22) emitting the light source in the color of the light-transmitting unit; the packages for each light emitting element (22) forms the optical light-transmitting structure, thereby regulating the path of the emitted light source from the light emitting elements (22), and resulting in the convergence or uniform distribution effect of light. In addition, the surfaces of the light emitting elements (22) can be covered with colored light-transmitting units or light-transmitting units with optical light-transmitting structures to achieve the effect of the emitted light source provided with the corresponding colour or the convergence or uniform distribution of light.

In the inventive lamp structure (1), the power supply (30) is the power source required by the lamp structure (1), and more particular, one embodiment of the power supply (30) of the present invention is the power supply (30) to be installed internally to the case (10), and the power supply (30) comprises a battery holder, and common batteries (not shown) can be utilized as the power source. Furthermore, the power supply (30) can also be an external power source to the case (10), and specifically, the power supply (30) is an external connected battery holder or an adapter electrically connected to the city power grid, the power supplied by the power supply (30) is directed to the electrical circuit (40) through the electrical connection to provide the desired power for the light emitting part (20).

In the inventive lamp structure (1), the electrical circuit (40) is the main electric circuit connecting the light emitting part (20) to the power supply (30), and the electrical circuit (40) comprises a first electrical contact (42) and a second electrical contact (44), where the first electrical contact (42) and the second electrical contact (44) are open circuited in between.

Furthermore, the first electrical contact (42) and the second electrical contact (44) can respectively be a plate with conductive properties, the plates can be made with conductive materials, or by disposing the conductive materials on an non-conductive material substrate.

In the inventive lamp structure (1), the sliding piece (51) is installed in the hollow part (100) of the case (10) next to the upper lid (11) and is restricted to move between a first position (as indicated in FIG. 6) and a second position (as indicated in FIG. 7), and on one side of the sliding piece (51) has a conductor (53) and an extension (54), where the conductor (53) is a conductive material that corresponds to the first electrical contact (42) and the second electrical contact (44), the extension (54) has an extension rod (540) and a circular plate shaped press detent (542), one end of the extension rod (540) is connected to the side face of the sliding piece (51) with the conductor (53), the press detent (542) is in the form of circular plate, and the other end of the extension rod (540) comes in contact with the side surface of the press detent (542); wherein when the sliding piece is located at the first position, the press detent (542) moves to be concealed within the opening part (13); and when the sliding piece is located at the second position, the press detent (542) moves to protrude out of the opening part (13). Furthermore, with the operation of the spring element (52), the position of the press detent (542) can directly move the position of the sliding piece (51) to form a sliding mechanism, and subsequently making contact for the conductor (53) to the first electrical contact (42) and the second electrical contact (44), completing the electrical connection to the electrical circuit (40), or disengaging the conductor (53) from the first electrical contact (42) and the second electrical contact (44) to be an open circuit.

Furthermore, the case (10) can provide with two parallel protruding strips (14, 15), where the sliding piece (51) is sandwiched in between, and the two protruding strips (14, 15) are in parallel with the extension rod (540). The two protruding strips (14, 15) are mainly for restricting the sliding piece (51) to move between the first position and the second position in parallel to their direction.

The spring element (51), such as a spring, is a mechanical element with elastic recovery force, and the spring element (51) is connected at one end to a stopper (16) in the case (10), and the other end is secured to the notch (55) on the sliding piece (51).

Based on the aforesaid inventive lamp structure (1), the conductor (53) on the sliding piece (51) can selected either state of the close circuit state or open circuit state between the first electrical contact (42) and the second electrical contact (44), in which, the close circuit state is the state of the conductor (53) electrically connected to the first electrical contact (42) and the second electrical contact (44), the open circuit state is the state of the conductor (53) disengages from the first electrical contact (42) and the second electrical contact (44); the first position corresponds to the open circuit selected by the sliding piece (51) and the second position corresponds to the close circuit selected by the sliding piece (51); and the protruded position of the press detent (542) relative to the surface of the case (10) corresponds to one of the first position and second position of sliding piece (51).

Referring to FIG. 6 and FIG. 7 again, FIG. 6 and FIG. 7 are the schematic diagrams for the first position and the second position of the lamp structure (1) installed in a cabinet. The lamp structure (1) is installed internally to a cabinet (60) and the installation method comprises securing with screws or adhered inside the cabinet (is not relevant to characteristic of the present invention, so no further description in the detail); when installed in the cabinet (60), the opening part (13) of the case (10) will face toward the external space of the cabinet (60), while the side of the case (10) provided with the light emitting part (20) will face the internal space of the cabinet (60); when a door (62) on the cabinet (60) is closed, the door (62) will push against the press detent (542) to move the extension rod (540) and the sliding piece (51) to the inside of the case (10), thereby reaching to the default second position; the spring element (52) will also be compressed by pushing to enable the conductor (53) on the sliding piece (51) disengage from the first electrical contact (42) and the second electrical contact (44), resulting in an open circuit state where the light emitting part (20) will not generate the light illumination; in the contrast, if the cabinet (60) is opened, the door (62) will release the press detent (542) for the spring element (52) to recover from the compression and push on the sliding piece (51), subsequently the press detent (542) will protrude from the opening part (13), resulting in the sliding piece (51) to move to reach the default first position; hence the conductor (53) will come in contact with the first electrical contact (42) and the second electrical contact (44), at this time the whole circuit exhibits open-circuit state, and the light emitting part (20) can generate the light illuminated to the internal space of the cabinet (60).

Therefore, the present invention provides a novel lamp structure, can convenience the user to illuminate the internal space of the cabinet; thereby the present invention is highly improved and conforms to the conditions of newly applied patents, and hereby this patent application is claimed in accordance to regulations.

The present invention has been described by way of example while a preferred embodiment is provided for illustration purposes only, it should be understood that the invention is not limited thereto; to the contrary, it is intended to cover various changes and modifications. Therefore, the scope of the appended claims should be accorded the broadest interpretation so as to encompass all such changes and modifications.

What is claimed is:

1. A lamp structure comprising:

a case including a housing structure with a hollow part, having a top opening and a lower opening sealed with an upper lid and a lower lid respectively, and having an end opening part for the hollow part communicating with the outside of the case;

a light emitting part including a plurality of light emitting elements installed on the surface of the case;

a power supply being the main power source of the entire structure, and being disposed inside the case next to the lower lid;

an electrical circuit mainly for electrically connecting the light emitting part to the power supply further comprising a first electrical contact and a second electrical contact, and the first electrical contact and the second electrical contact forming an open circuit to each other;

a sliding piece having two opposite sides, being installed inside the case next to the upper lid, being restricted to move between a first position and a second position, and further comprising a conductor and an extension, wherein the conductor is disposed at one of the opposite sides of the sliding piece corresponding to the first electrical contact and the second electrical contact, the extension further comprises an extension rod and a circular plate shaped press detent, one end of the extension rod connects with the conductor, the other end of the extension rod keeps contact with a side surface of the press detent, and the press detent is capable of moving to pass through the opening part;

two protruding strips being disposed next to the first and second electrical contacts respectively, and sandwiching the sliding piece;

a spring element being disposed at another one of the two opposite sides of the sliding piece, having one end affixing to a stopper joined to the case, and having the other end secured to the sliding piece;

wherein the conductor is electrically connected to the first contact and the second electrical contact to form a close circuit state when the press detent is free from being pushed and protrudes out of the case via the opening part to result in the sliding piece being moved to the first position, and disengages from the first electrical contact and the second electrical contact to form an open circuit state when the press detent is pushed against an elastic recovery force of the spring element and moves into the case via the opening part to result in the sliding piece being moved to the second position.

2. The lamp structure as claimed in claim 1, wherein the protruding strips are parallel to the extension rod.

3. The lamp structure as claimed in claim 1, wherein the other one of the two opposite sides of the sliding piece has a notch in contact with the spring element, and the notch extends along a direction parallel with the protruding strips.

4. The lamp structure as claimed in claim 1, wherein the spring element is a spring.

5. The lamp structure as claimed in claim 1, wherein the first electrical contact and the second electrical contact are electrode plates.

6. The lamp structure as claimed in claim 1, wherein the light emitting area of the light emitting elements is covered with colored light-transmitting materials.

7. The lamp structure as claimed in claim 1, wherein the light emitting area of the light emitting elements is covered with light-transmitting materials with optical light-transmitting structure.

* * * * *